United States Patent [19]

Kiuchi et al.

[11] Patent Number: 4,582,036

[45] Date of Patent: Apr. 15, 1986

[54] FUEL SUPPLY CONTROL METHOD FOR INTERNAL COMBUSTION ENGINES IMMEDIATELY AFTER CRANKING

[75] Inventors: Takeo Kiuchi, Asaka; Akihiro Yamato, Shiki, both of Japan

[73] Assignee: Honda Giken Kogyo K.K., Tokyo, Japan

[21] Appl. No.: 648,654

[22] Filed: Sep. 6, 1984

[30] Foreign Application Priority Data

Sep. 12, 1983 [JP] Japan ..... 58-168061
May 11, 1984 [JP] Japan ..... 59-93998

[51] Int. Cl.[4] ..... F02N 17/00

[52] U.S. Cl. ..... 123/491; 123/179 G; 123/179 L

[58] Field of Search ..... 123/179 L, 491, 179 G

[56] References Cited

U.S. PATENT DOCUMENTS

| | | | |
|---|---|---|---|
| 3,566,846 | 3/1971 | Glockler | 123/491 |
| 4,114,570 | 9/1978 | Marchak | 123/179 L |
| 4,205,635 | 6/1980 | Kirn | 123/491 |
| 4,246,639 | 1/1981 | Carp | 123/491 |
| 4,478,194 | 10/1984 | Yamato et al. | 123/491 |

*Primary Examiner*—Ronald B. Cox

*Attorney, Agent, or Firm*—Arthur L. Lessler

[57] ABSTRACT

A fuel supply control method of controlling the quantity of fuel being supplied to an internal combustion engine after cranking thereof. Upon generation of a predetermined control signal immediately after the cranking of the engine, an initial value of a fuel increment is set, which corresponds to the engine temperature. Subsequently, the set initial value is decreased at a predetermined rate upon each generation of the predetermined control signal. A quantity of fuel is set by the use of the thus decreased value of the fuel increment and supplied to the engine in synchronism with generation of the predetermined control signal. When the fuel increment has a value larger than a predetermined reference value, the value of the fuel increment is decreased at a first rate, while when it has a value smaller than the predetermined reference value, it is decreased at a second rate smaller than the first rate. Preferably, the predetermined reference value assumes a value dependent upon the initial value of the fuel increment, e.g. a product obtained by multiplying the initial value of the fuel increment by a predetermined coefficient. Further preferably, when the fuel increment value is smaller than a fixed value, it is decreased at the second rate, even if it is larger than the predetermined reference value.

5 Claims, 12 Drawing Figures

FUEL SUPPLY CONTROL PROGRAM
1
START CONTROL
2
BASIC CONTROL
3
TiCR TABLE
4
KNe TABLE
5
TV TABLE
6
BASIC Ti MAP
7
ACC/DEC SUBROUTINES
8
COEFFICIENT CALCULATING TABLES, SUBROUTINES
9
TV TABLE
6

FUEL SUPPLY CONTROL METHOD FOR INTERNAL COMBUSTION ENGINES IMMEDIATELY AFTER CRANKING

BACKGROUND OF THE INVENTION

This invention relates to a control method of controlling the quantity of fuel being supplied to an internal combustion engine immediately after cranking thereof, and more particularly to such a control method, which is adapted to set the quantity of fuel being supplied to the engine immediately after cranking thereof to appropriate values in response to changes in the engine temperature, to thereby achieve stable operation of the engine.

Among conventional fuel supply quantity control methods for internal combustion engines, it has been generally known as starting fuel supply control to control the fuel quantity being supplied to the engine to an appropriate value corresponding to the cooling water temperature of the engine representative of the engine temperature, at cranking of the engine so as to ensure positive and smooth starting of the engine, while it has also been known as basic fuel supply control to control the fuel quantity being supplied to the engine to a value set by multiplying and/or adding to a basic value of the fuel quantity dependent upon operating parameters of the engine such as engine rotational speed and intake pipe absolute pressure by correction coefficients and/or correction variables depending upon the engine cooling water temperature, throttle valve opening, exhaust gas ingredient ($O_2$) concentration, etc., after the engine has left the cranking state.

In order to obtain smooth transition from the cranking operation of the engine under the starting fuel supply control to normal operation of same under the basic fuel supply control, to prevent engine stall after the cranking of the engine, and to improve driveability of the engine at acceleration immediately after the cranking of same, a fuel supply control method has been proposed, e.g. by Japanese Provisional Patent Publication (Kokai) No. 59-46329, which comprises setting an initial value of a fuel increment which is applied immediately after the cranking of the engine, in response to a product of a value of a cooling water temperature-dependent fuel increasing coefficient KTW of which the value decreases as the engine coolant temperature representative of the engine temperature increases, and a value of an after-start fuel increasing coefficient KAST, subsequently decreasing the initial value of the fuel increment by a predetermined value upon generation of each pulse of a top-dead-center (TDC) signal, and supplying the engine with a quantity of fuel set by the use of the thus set fuel increment.

According to this proposed fuel supply control method, however, because the value of the fuel increment is decreased in a substantially linear manner, the fuel quantity supplied to the engine does not always assume values appropriate for operating conditions of the engine.

To increase the fuel supply quantity after the cranking of the engine while the engine is in a cold state has originally been intended to compensate for leaning of the air/fuel mixture actually supplied to the engine due to incomplete evaporation of the fuel adhering to the cold inner walls of the intake pipe and the cylinders of the engine. However, the temperature of the inner walls of the cylinders rapidly increases as combustion repeatedly takes place within the same cylinder after the cranking of the engine, to promote the evaporation of fuel adhering to the inner walls of the cylinders, etc. Therefore, according to the above-mentioned fuel supply control method which decreases the fuel quantity in a substantially linear manner even while the temperature of the cylinders is rapidly increasing, the air/fuel mixture supplied to the engine becomes rich, deteriorating the ignition plug. To be specific, while during cranking, the air/fuel ratio of the mixture supplied to the engine should be very rich or smaller than 10 so as to make up for the adhesion of fuel to the inner walls or a small evaporation rate thereof, as described hereinabove, continued supply of such a rich mixture to the engine can cause accumulation of carbon on the plug or moistening of the plug with the fuel, adversely affecting the operation of the plug.

On the other hand, in order to ensure stable warming-up operation of the engine following the cranking, it is desirable to gradually decrease the fuel supply quantity so that the air/fuel ratio of the mixture becomes slightly richer than the theoretical air/fuel ratio, insofar as the aforesaid phenomena such as the accumulation of carbon on the plug can be avoided.

This requirement could be fulfilled, for instance, by accurately detecting the temperature of the inner walls of the cylinders and thereby setting the fuel supply quantity to a suitable value. However, in practice, the engine temperature is generally detected in terms of the engine cooling water temperature, which involves a problem of a time lag between a change in the temperature of the inner walls of the cylinders and the resulting change in the cooling water temperature, making it difficult to accurately detect the temperature of the inner walls of the cylinders.

SUMMARY OF THE INVENTION

It is the object of the invention to provide a fuel supply control method for internal combustion engines, which is adapted to accurately set the fuel quantity being supplied to the engine immediately after cranking thereof to proper values responsive to changes in the engine temperature, to thereby prevent accumulation of carbon on the plug and moistening of the plug with fuel, as well as to ensure stable operation of the engine following the cranking operation.

According to the present invention, there is provided a method of controlling the quantity of fuel being supplied to an internal combustion engine after cranking thereof, which is adapted to set an initial value of a fuel increment, which corresponds to the temperature of the engine, upon generation of a predetermined control signal immediately after completion of the cranking of the engine, subsequently decrease the set initial value of the fuel increment at a predetermined rate upon each generation of the predetermined control signal, and supply the engine with a quantity of fuel set by the use of the thus decreased fuel increment, in synchronism with generation of the predetermined control signal. The method is characterized by comprising the following steps: (1) comparing the value of the fuel increment with a predetermined reference value upon each generation of the predetermined control signal; (2) decreasing the value of the fuel increment at a first rate when it is larger than the predetermined reference value; and (3) decreasing the value of the fuel increment at a second rate which is smaller than the first rate when the value of the fuel increment is smaller than the predetermined reference value.

Preferably, the predetermined reference value of the fuel increment assumes a value dependent upon the set initial value of the fuel increment, e.g. a product obtained by multiplying the set initial value of the fuel increment by a predetermined coefficient.

Further preferably, the method according to the present invention includes the steps of comparing the value of the fuel increment with a fixed value upon each generation of the predetermined control signal, and decreasing the value of the fuel increment at the second rate when the value of the fuel increment is smaller than the fixed value, even if the value of the fuel increment is larger than the predetermined reference value.

The above and other objects, features and advantages of the invention will be more apparent from the ensuing detailed description taken in conjunction with the accompanying drawings.

DETAILED DESCRIPTION

The invention will now be described in detail with reference to the drawings.

Figure 1:
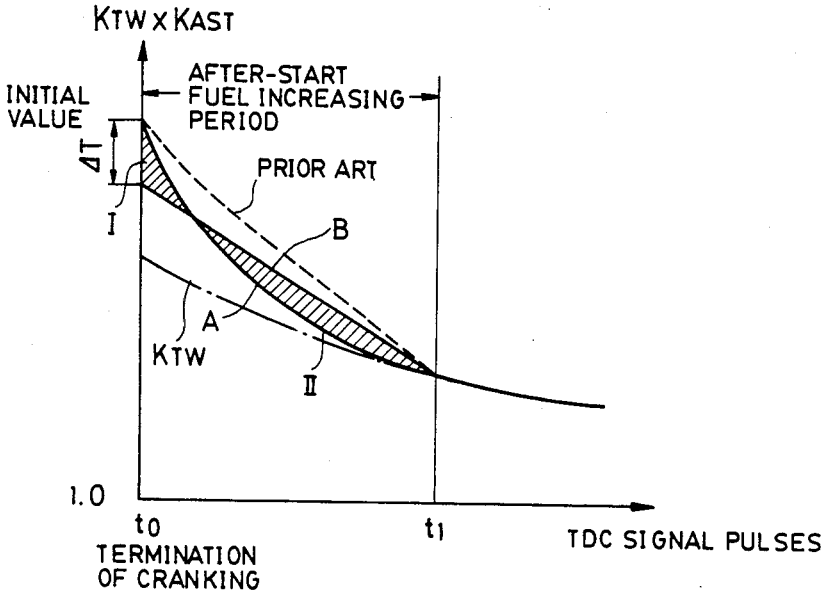
FIG. 1 is a graph showing a manner of controlling the fuel supply quantity during an after-start fuel increasing period, according to a conventional method.
Figure 10:
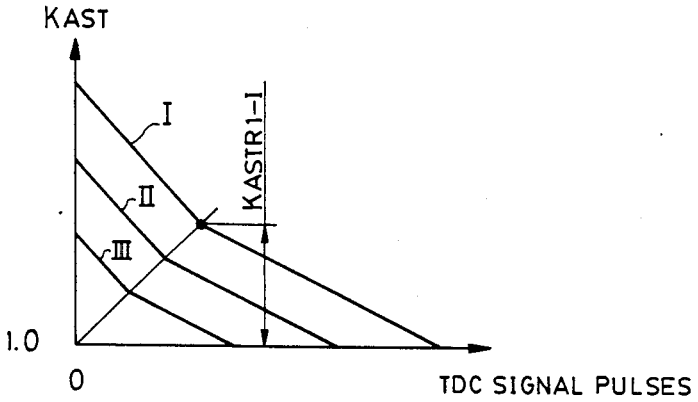
FIG. 10 is a graph showing a manner of decreasing the value of the after-start fuel increasing coefficient KAST, calculated in the manner shown in FIG. 7, upon generation of each pulse of the TDC signal.

FIG. 1 is a view showing a manner of controlling the fuel supply quantity after cranking of the engine, according to the conventionally proposed method disclosed in Japanese Provisional Patent Publication (Kokai No. 59-46329, hereinbefore referred to. As shown in FIG. 1, a product obtained by multiplying a value of a cooling water temperature-dependent fuel increasing coefficient KTW provided for increasing a basic fuel supply quantity, by a value of an after-start fuel increasing coefficient KAST is decreased upon generation of each pulse of the TDC signal immediately after cranking of the engine. The after-start fuel increasing coefficient KAST has its initial value KAST0 set to a product of a value of the cooling water temperature-dependent fuel increasing coefficient KTW which is set upon generation of a first pulse of the TDC signal immediately after the cranking of the engine, and a value of a variable CAST which is set in response to the engine cooling water temperature TW. The initial value of the after-start fuel increasing coefficient KAST thus set is decreased by a predetermined fixed value upon generation of each subsequent preceding pulse of the TDC signal.

More specifically, according to the above proposed method, as is supposed from the grpah of FIG. 1, the quantity of fuel being supplied to the engine will decrease in a substantially linear manner from the time of termination of the cranking of the engine indicated by t0 in FIG. 1 when the after-start fuel increasing coefficient KAST assumes its initial value, to the time of generation of a TDC signal pulse indicated by t1 in FIG. 1 when the value of the after-start fuel increasing coefficient KAST becomes equal to 1.0, by substracting a predetermined fixed value from the value thereof upon generation of each pulse of the TDC signal, as indicated by the broken line in FIG. 1, which indicates the product of the values of the coefficients KTW and KAST. Thereafter, the fuel supply quantity is corrected by the use of the cooling water temperature-dependent coefficient KTW alone. By thus gradually decreasing the fuel supply quantity during a period from the time point t0 at termination of the cranking of the engine to the time point t1 (hereinafter referred to as "the after-start fuel increasing period"), it is intended to obtain smooth transition from a cranking state of the engine to normal operation of same after the time point t1 under basic fuel supply control. However, according to the proposed method which decreases the fuel supply quantity along a substantially straight line, the fuel quantity supplied to the engine during the after-start fuel increasing period cannot always assume values appropriate to the operation of the engine for the following reasons:

The temperature of the inner walls of the cylinders rapidly increases as combustion repeatedly takes place in the same cylinder immediately after cranking of the engine, which promotes evaporation of the fuel adhering to the inner walls of the cylinders, etc. As a result, the quantity of fuel actually required by the engine during the after-start fuel increasing period should correspond to the solid line A in FIG. 1 indicative of the product of the values of the coefficients KTW and KAST (hereinafter referred to as "the product of KTW X KAST"). However, according to the conventional method which decreases the product of KTW X KAST along a substantially straight line, the air/fuel ratio of the mixture supplied to the engine becomes too rich during a latter portion of the after-start fuel increasing period, adversely affecting the operation of the ignition plug and combustion within the cylinders. Furthermore, since the engine temperature is detected in terms of the engine cooling water temperature, a time lag between a change in the temperature of the inner walls of the cylinders and the reulting change in the cooling water temperature makes it difficult to accurately detect the temperature of the inner walls of the cylinders, as previously stated.

To approximate the product of KTW X KAST to the values indicated by the solid line A, another method is possible, it could be effective to set a solid straight line B, as shown in FIG. 1, which gives an initival value of the product of KTW X KAST smaller than that given by the solid line A by a value T, and supply the the engine with a quantity of fuel corresponding to the product KTW X KAST obtained along the solid line B. However, according to this method, the quantity of fuel supplied to the engine immediately after the cranking thereof suddenly decreases by a large amount which corresponds to the value $\Delta T$, causing unstable operation of the engine. Further, during the period I hatched in FIG. 1, the mixture becomes lean, while during the period II also hatched in FIG. 1, it becomes rich. Thus, this method also provides an incomplete solution.

Figure 2:
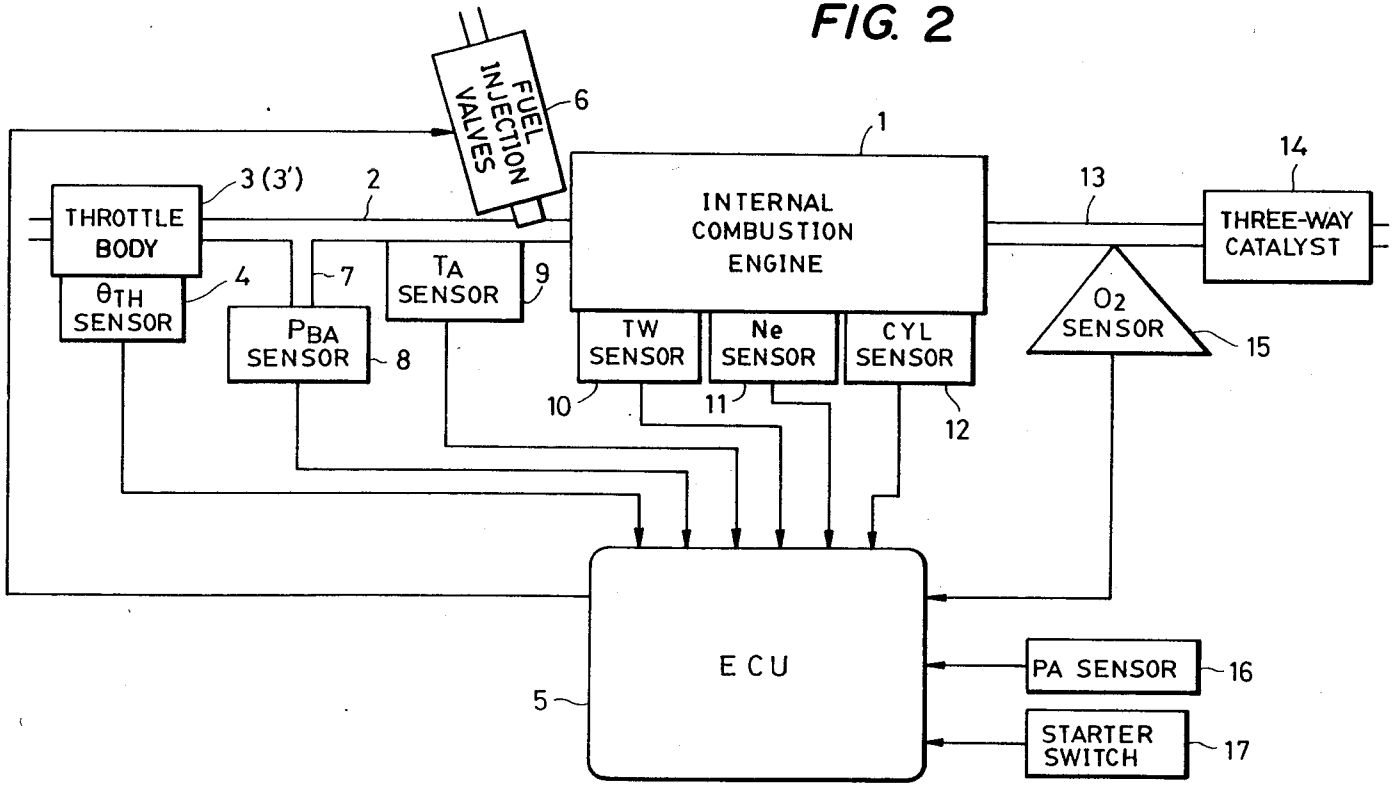
FIG. 2 is a block diagram illustrating the whole arrangement of a fuel supply control system to which is applicable the method according to the invention.

In FIG. 2, there is illustrated the whole arrangement of a fuel supply control system for internal combustion engines, to which the present invention is applicable. Reference numeral 1 designates an internal combustion engine which may be a four-cylinder type for instance, and to which is connected an intake passage 2. A throttle body 3 is arranged across the intake passage 2, and accommodates a throttle valve 3'. A throttle valve opening ($\theta$th) sensor 4 is connected to the throttle valve 3' for detecting its valve opening and is electrically connected to an electronic control unit (hereinafter called "the ECU") 5, to supply same with an electrical signal indicative of the throttle valve opening detected thereby.

Fuel injection valves 6 are arranged in the intake passage 2 each at a location slightly upstream of an intake valve, not shown, of a corresponding one of the engine cylinders, not shown, and between the engine 1 and the throttle body 3, for fuel supply to the corresponding engine cylinder. Each of such fuel injection valves 6 is connected to a fuel pump, not shown, and is electrically connected to the ECU 5, in a manner having their valve opening periods or fuel injection quantities controlled by signals supplied from the ECU 5.

On the other hand, an absolute pressure (PBA) sensor 8 communicates through a conduit 7 with the interior of the intake passage 2 at a location downstream of the throttle valve 3' of the throttle body 3. The absolute pressure (PBA) sensor 8 is adapted to detect absolute pressure in the intake passage 2 and applies an electrical signal indicative of detected absolute pressure to the ECU 5. An intake air temperature (TA) sensor 9 is arranged in the intake passage 2 at a location downstream of the absolute pressure (PBA) sensor 8 and also electrically connected to the ECU 5 for supplying same with an electrical signal indicative of detected intake air temperature.

An engine cooling water temperature (TW) sensor 10, which may be formed of a thermistor or the like, is mounted on the cylinder block of the engine 1 in a manner embedded in the peripheral wall of an engine cylinder having its interior filled with cooling water, of which an electrical output signal indicative of detected water temperature is supplied to the ECU 5.

An engine speed (Ne) sensor 11 and a cylinder-discriminating (CYL) sensor 12 are arranged on a camshaft, not shown, of the engine 1 or a crankshaft of same, not shown. The former 11 is adapted to generate one pulse at particular crank angles each time the engine crankshaft rotates through 180 degrees, i.e., one pulse of the top-dead-center position (TDC) signal, while the latter is adapted to generate one pulse at a particular crank angle of a particular engine cylinder. The above pulses generated by the sensors 11, 12 are supplied to the ECU 5.

A three-way catalyst 14 is arranged in an exhaust pipe 13 extending from the cylinder block of the engine 1 for purifying ingredients HC, CO and NOx contained in the exhaust gases. An $O_2$ sensor 15 is inserted in the exhaust pipe 13 at a location upstream of the three-way catalyst 14 for detecting the concentration of oxygen in the exhaust gases and supplying an electrical signal indicative of a detected concentration value to the ECU 5.

Further connected to the ECU 5 are a sensor 16 for detecting atmospheric pressure (PA) and a starter switch 17 for actuating the starter of the engine 1, respectively, for supplying an electrical signal indicative of detected atmospheric pressure and an electrical signal indicative of its own on and off positions to the ECU 5.

.The ECU 5 operates to calculate the valve opening period TOUT of the fuel injection valves 6 in a manner hereinafter described in detail, and supplies driving signals corresponding to the calculated TOUT value to the fuel injection valves 6 to open same.

Figure 3:
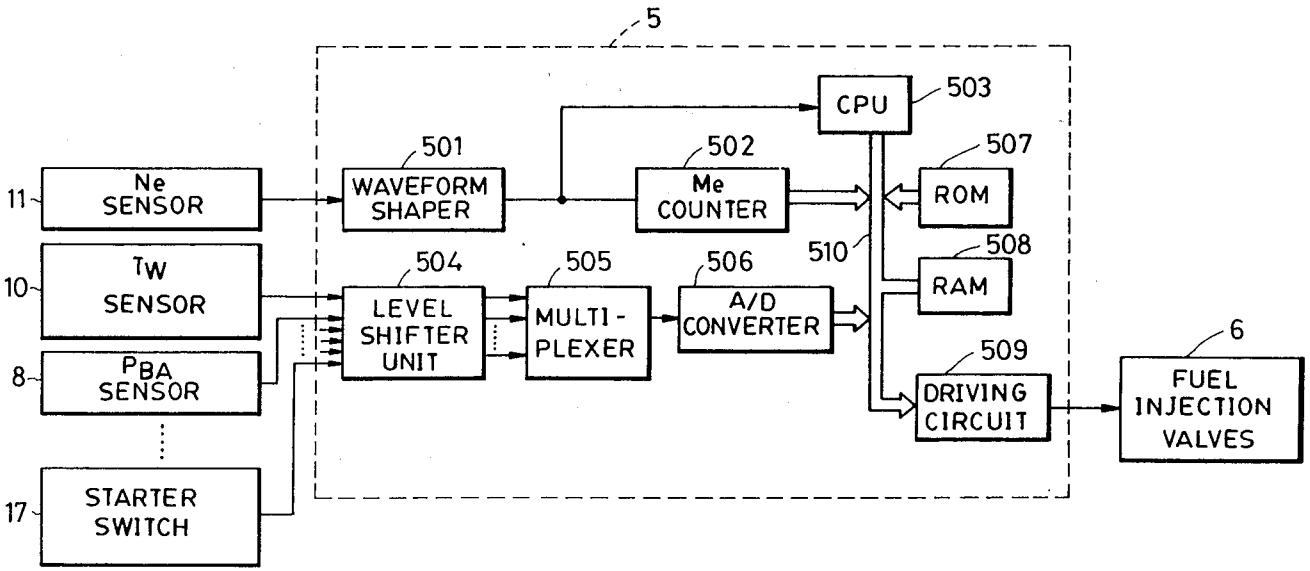
FIG. 3 is a block diagram illustrating the interior arrangement of an electronic control unit (ECU) appearing in FIG. 2.

FIG. 3 shows a circuit configuration within the ECU 5 in FIG. 2. An output signal from the Ne sensor 11 in FIG. 2 indicative of the rotational speed of the engine is applied to a waveform shaper 501, wherein it has its pulse waveform shaped, and supplied to a central processing unit (hereinafter called "the CPU") 503, as well as to an Me value counter 502, as the TDC signal. The Me value counter 502 counts the interval of time between a preceding pulse of the TDC signal and a present pulse of the same signal, inputted thereto from the Ne sensor 11. Therefore, its counted value Me corresponds to the reciprocal of the actual engine rotational speed Ne. The Me value counter 502 supplies the counted value Me to the CPU 503 via a data bus 510.

The respective output signals from the intake pipe absolute pressure (PBA) sensor 8, the engine coolant temperature (TW) sensor 10, the starter switch 17, all appearing in FIG. 2, and other sensors have their voltage levels shifted to a predetermined voltage level by a level shifter unit 504 and successively applied to an analog-to-digital converter 506 through a multiplexer 505. The analog-to-digital converter 506 successively converts into digital signals analog output voltages from the aforementioned various sensors, and the resulting digital signals are supplied to the CPU 503 via the data bus 510.

Further connected to the CPU 503 via the data bus 510 are a read-only memory (hereinafter called "the ROM") 507, a random access memory (hereinafter called "the RAM") 508 and a driving circuit 509. The RAM 508 temporarily stores various calculated values from the CPU 503, while the ROM 507 stores a control program to be executed within the CPU 503 as well as a table of values of the engine coolant temperature-dependent fuel increasing coefficient KTW and a table of values of the engine coolant temperature-dependent coefficient CAST, both of which are subjected to selective reading of their values in manners as hereinafter described, etc. The CPU 503 executes the control program stored in the ROM 507 to calculate the fuel injection period TOUT for the fuel injection valves 6 in response to the various engine operation parameter signals, and supplies the calculated period value to the driving circuit 509 through the data bus 510. The driving circuit 509 supplies driving signals corresponding to the above calculated TOUT value to the fuel injection valves 6 to drive same.

Next, the operation of the fuel supply control system arranged as above will now be described with reference to FIGS. 1 through 3 referred to hereinabove and FIGS. 4 through 10.

Figure 4:
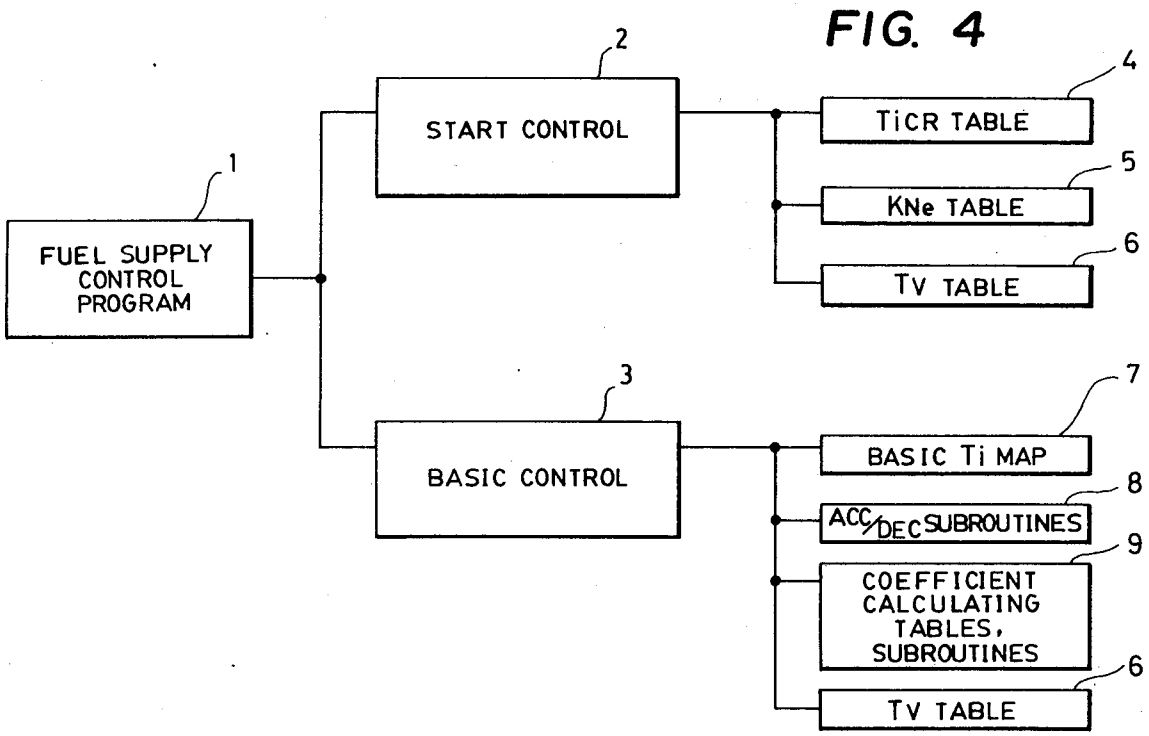
FIG. 4 is a block diagram illustrating a program for control of the valve opening period TOUT of fuel injection valves of the engine, which is executed by the ECU in FIG. 2.

Referring to FIG. 4, there is illustrated the whole program for fuel supply control, i.e. control of the valve opening period TOUT of the fuel injection valves 6, which is executed by the ECU 5. The fuel supply control program 1 is executed in synchronism with generation of the TDC signal, and comprises a start control subroutine 2 and a basic control subroutine 3.

In the start control subroutine 2, the valve opening period TOUT is determined by the following basic equation:

$$TOUT = TiCR \times KNe + TV \quad (1)$$

where TiCR represents a basic value of the valve opening period for the fuel injection valves, which is determined from a TiCR table 4, KNe represents a correction coefficient applicable at the start of the engine, which is variable as a function of engine rotational speed Ne and determined from a KNe table 5, and TV represents a correction value for increasing or decreasing the valve opening period in response to changes in the output voltage of the battery, which is determined from a TV table 6.

The basic equation for determining the value TOUT applicable to the basic control subroutine 3 is as follows:

$$TOUT = (Ti - TDEC) \times (KTA \times KTW \times KAFC \times KPA \times KAST \times KWOT \times KO_2 \times KLS) + TACC \times (KTA \times KTWT \times KAFC) + TV \quad (2)$$

where Ti represents a basic value of the valve opening period for the fuel injection valves, and is determined from a basic Ti map 7, and TDEC and TACC represent correction values applicable, respectively, at engine deceleration and at engine acceleration and are determined by acceleration and deceleration subroutines 8. KTA, KTW, etc. represent correction coefficients which are determined by their respective tables and/or subroutines 9. KTA is an intake air temperature-dependent correction coefficient and is determined from a table as a function of actual intake air temperature, KTW the engine cooling water temperature-dependent fuel increasing coefficient which is determined from a table as a function of actual engine cooling water temperature TW, KAFC a fuel increasing coefficient applicable after fuel cut operation and determined by a subroutine, KPA an atmospheric pressure-dependent correction coefficient determined from a table as a function of actual atmospheric pressure, and KAST a fuel increasing coefficient applicable after the start of the engine and determined by a subroutine. KWOT is a coefficient for enriching the air/fuel mixture, which is applicable at wide-open-throttle and has a constant value, $KO_2$ an "$O_2$ sensor output-responsive feedback control" correction coefficient determined by a subroutine as a function of actual oxygen concentration in the exhaust gases, and KLS a mixture-leaning coefficient applicable at "lean stoich." operation and having a constant value. The term "stoich." is an abbreviation of a word "stoichiometric" and means a stoichiometric or theoretical air/fuel ratio of the mixture.

Figure 5:
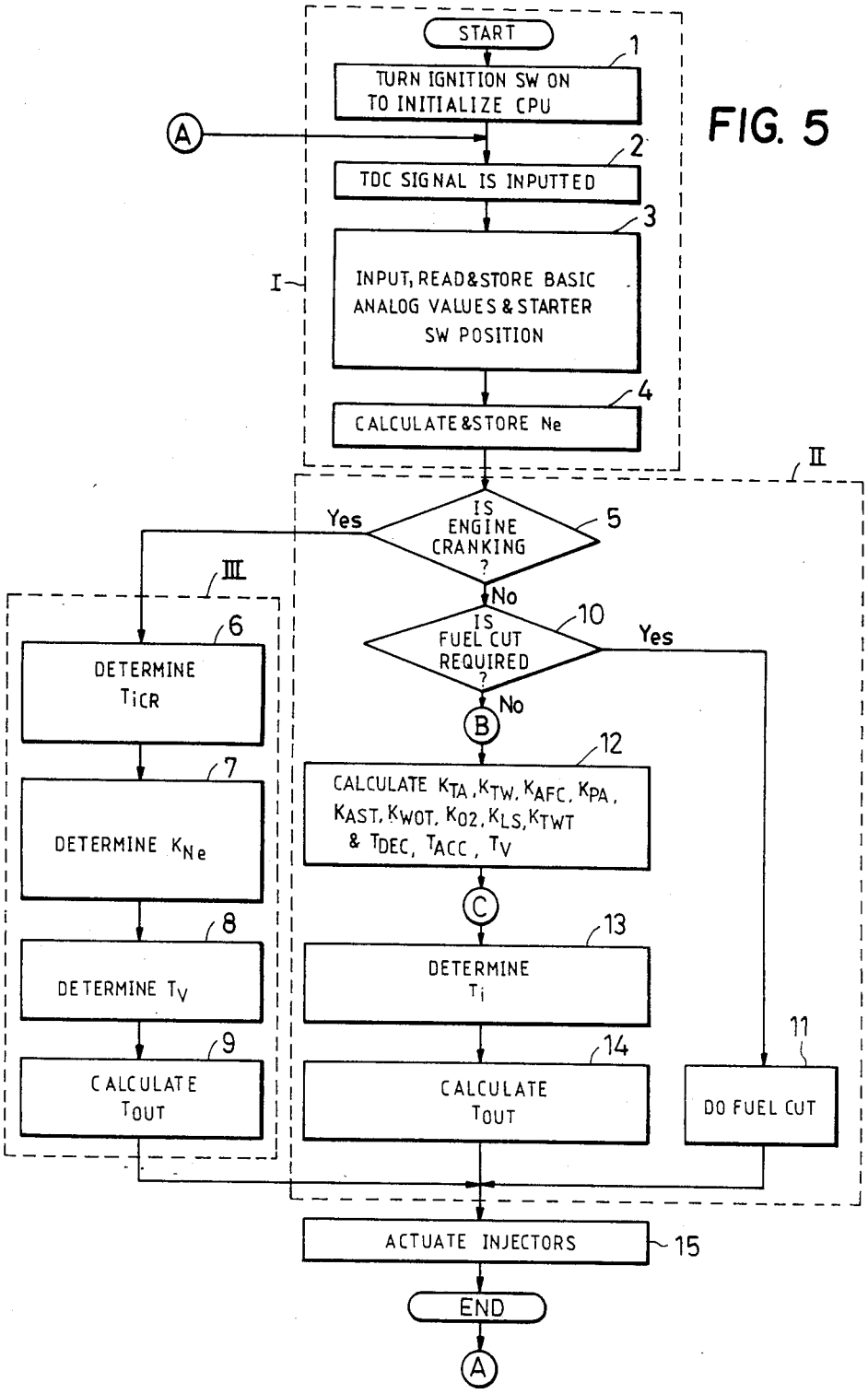
FIG. 5 is a flow chart showing a main program for control of the valve opening period TOUT.

Referring next to FIG. 5, there is shown a flow chart of the aforementioned fuel supply control program 1 for control of the valve opening period, which is executed by the CPU 503 in FIG. 3 in synchronism with generation of the TDC signal. The whole program comprises an input signal processing block I, a basic control block II and a start control block III. First in the input signal processing block I, when the ignition switch of the engine is turned on, the CPU 503 is initialized at the step 1 and the TDC signal is inputted to the ECU 5 as the engine starts at the step 2. Then, all basic analog values are inputted to the ECU 5, which include detected values of atmospheric pressure PA, absolute pressure PBA, engine cooling water temperature TW, intake air temperature TA, battery voltage V, throttle valve opening $\theta$TH, output voltage value V of the $O_2$ sensor and on-off state of the starter switch 17, some necessary ones of which are then stored therein (step 3). Further, the period between a pulse of the TDC signal and the next pulse of same is counted to calculate the actual engine rotational speed Ne on the basis of the counted value, and the calculated value is stored in the ECU 5 (step 4). The program then proceeds to the basic control block II. In this block, a determination is made, in a manner hereinafter described in detail, as to whether or not the engine is in a cranking state, at the step 5. If the answer is affirmative, the program proceeds to the start control subroutine III. In this block, a TiCR value is selected from the TiCR table 4 in FIG. 4, on the basis of the detected value of engine cooling water temperature TW (step 6). Also, the value of Ne-dependent correction coefficient KNe is determined by using the KNe table 5 (step 7). Further, the value of battery voltage-dependent correction value TV is determined by using the TV table 6 (step 8). These determined values are applied to the aforementioned equation (1) to calculate the value of TOUT (step 9).

If the answer to the question of the above step 5 is no, it is determined whether or not the engine is in a condition for carrying out fuel cut, at the step 10. If the answer is yes, the value of TOUT is set to zero, at the step 11.

On the other hand, if the answer to the question of the step 10 is negative, calculations are carried out of values of correction coefficients KTA, KTW, KAFC, KPA, KAST, KWOT, $KO_2$, KLS, KTWT, etc. and correction values TDEC, TACC, and TV, by means of the respective calculation subroutines and tables, at the step 12.

Then, a value of the basic valve opening period value Ti is selected from the Ti value map 7, which corresponds to data of actual engine rotational speed Ne and actual absolute pressure PBA and/or like parameters, at the step 13.

Then, a calculation is carried out of the value TOUT on the basis of the values of correction coefficients and correction values determined and selected at the steps 12 and 13, as described above, using the aforementioned equation (2) (step 14). The fuel injection valves 6 are actuated with a valve opening period corresponding to the value of TOUT obtained by the aforementioned step 9, 11 or 14 (step 15).

Next, a subroutine for determining whether or not the engine is in a cranking state, and a subroutine for calculating the value of the after-start fuel increasing coefficient KAST, as part of the control of the valve opening period described hereinabove will now be described.

Figure 6:
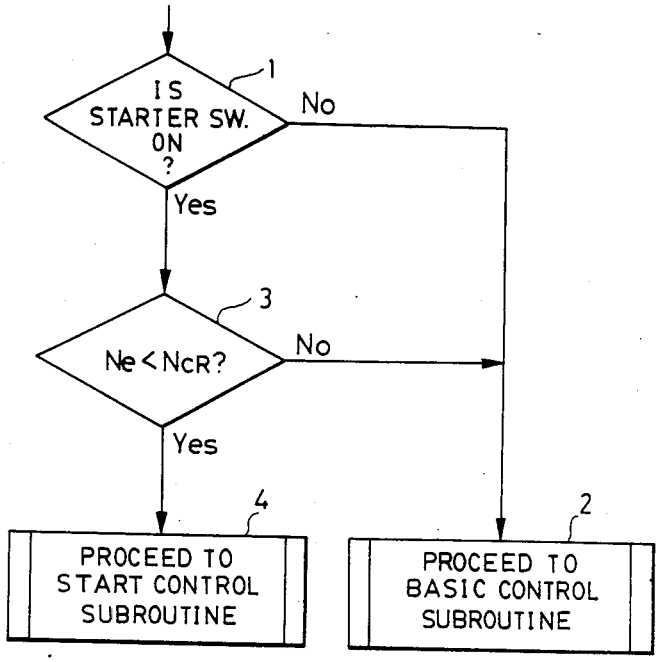
FIG. 6 is a flow chart showing a subroutine forming part of the program of FIG. 5, for determining a cranking state of the engine.

FIG. 6 shows a flow chart of the subroutine for executing the step 5 in FIG. 5 for determining whether or not the engine is in a cranking state. It is first determined at the step 1 whether or not the starter switch 17 in FIG. 2 is in an on or closed state. If the starter switch 17 is not on, it is assumed that the engine is not cranking, and the program proceeds to a basic control loop at the step 2, while if the switch 17 is on, a determination is made as to whether or not the engine rotational speed Ne is lower than a predetermined cranking speed NCR (e.g. 400 rpm), at the step 3. If the former is higher than the latter, the program proceeds to the above-mentioned basic control loop under the assumption that the engine is not cranking, at the step 2, whereas if the former is lower than the latter, the program proceeds to a start control loop (the block III in FIG. 5) under the assumption that the engine is cranking, at the step 4.

Figure 7:
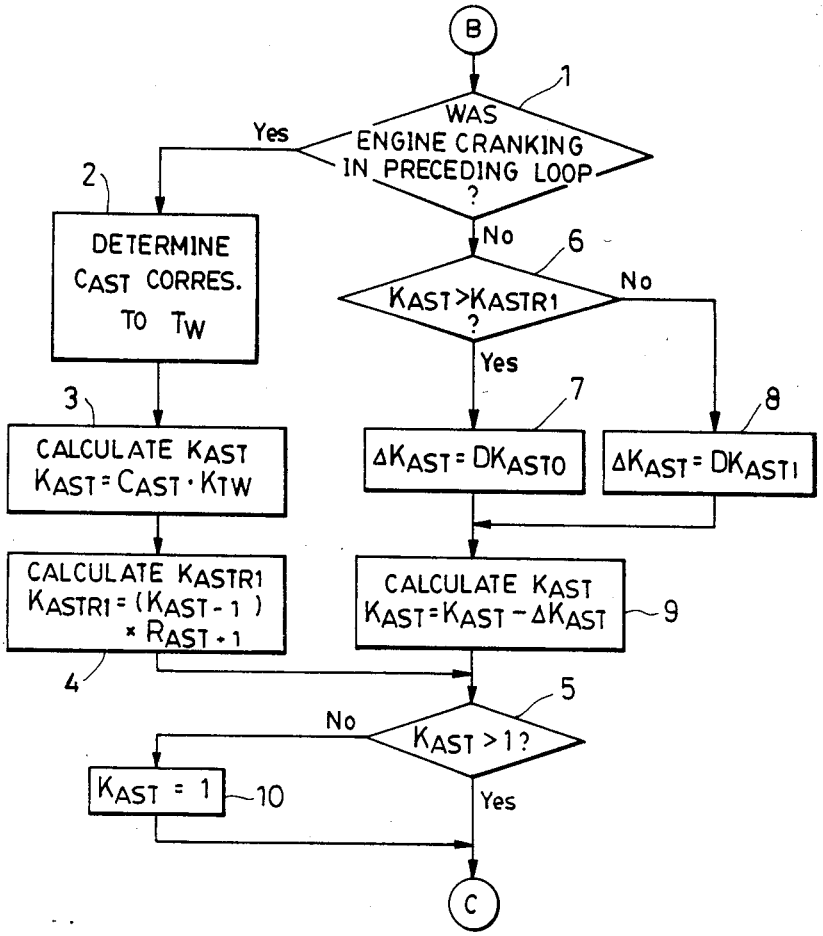
FIG. 7 is a flow chart showing a manner of calculating the value of an after-start fuel increasing coefficient KAST.
Figure 8:
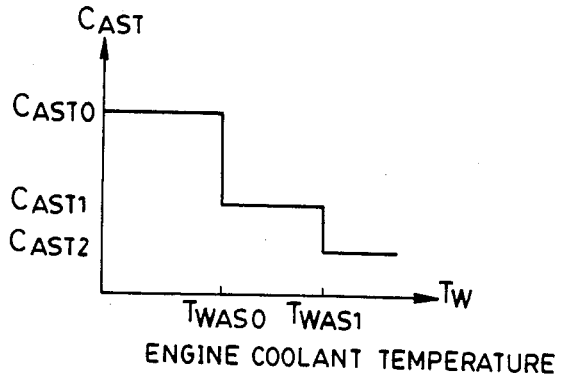
FIG. 8 is a graph showing a table of the relationship between a cooling water temperature-dependent fuel increasing coefficient CAST applied for calculation of the value of the after-start fuel increasing coefficient KAST and the engine cooling water temperature TW.

FIG. 7 shows a flow chart of the subroutine for calculating the value of the after-start fuel increasing coefficient KAST according to the method of the invention. First, it is determined at the step 1 whether or not the engine was in a cranking state in the last loop of execution of the subroutine. If the engine was cranking, a value of the coolant temperature-dependent coefficient CAST is read from the ROM 507 in FIG. 3 for calculation of the initial value of the after-start fuel increasing coefficient KAST, at the step 2. Shown in FIG. 8 is a table of values of the coefficient CAST set in relation to the engine coolant temperature TW. According to the example of the table, when the engine coolant temperature TW is lower than a predetermined value TWAS0 (e.g. 0° C.), a value CAST0 (e.g. 1.2) is selected as the value of the coefficient CAST, while when the engine coolant temperature TW is higher than the predetermined value TWAS0 and at the same time it is lower than a predetermined value TWAS1, a value CAST1 (e.g. 1.0) is selected as the coefficient value, and when the engine coolant temperature TW is higher than the predetermined value TWAS1, a value CAST2 (e.g. 0.8) is selected as the coefficient value. Setting of coefficient values is not limited to that of the illustrated table, but a wide variety of settings are possible in dependence on the operating characterisctis of the engine to which is applied the method of the invention.

Figure 9:
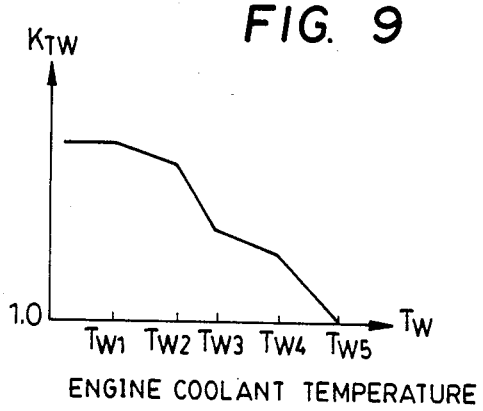
FIG. 9 is a graph showing a table of the relationship between a cooling water temperature-dependent fuel increasing coefficient KTW and the engine cooling water temperature TW.

Referring again to FIG. 7, the initial value of the after-start fuel increasing coefficient KAST is calculated on the basis of the value of the coolant temperature-dependent coefficient CAST read at the step 2, by the use of the following equation, at the step 3:

$$KAST = CAST \times KTW \quad (3)$$

where KTW represents the aforementioned coolant temperature-dependent fuel increasing coefficient, the value of which is determined from a table as a function of the engine coolant temperature TW as stated below. FIG. 9 shows a table of values of the fuel increasing coefficient KTW set in relation to the engine coolant temperature TW. According to the table, when the engine coolant temperature TW is higher than a predetermined value TW5 (e.g. 60° C.), the value of the coefficient KTW is held at 1.0, whereas when the temperature TW is equal to or lower than the predetermined value TW5, five predetermined values of the coefficient KTW are selected as the coolant temperature TW assumes respective five predetermined values TW1–TW5. If the coolant temperature TW assumes a value intervening between adjacent ones of the predetermined values, the value of the coefficient KTW is determined by means of an interpolation method.

Referring again to FIG. 7, the program then proceedes to the step 4, wherein a reference value KASTR1 of the after-start fuel increasing coefficient KAST is calculated. The reference value KASTR1 is provided to decrease the value of the after-start fuel increasing coefficient KAST at a larger rate until the value of the coefficient KAST becomes equal to the reference value KASTR1, and to decrease the value of the after-start fuel increasing coefficient KAST at a smaller rate after the value of the coefficient has become smaller than the reference value KASTR1, as hereinbelow described. The reference value KASTR1 is calculated by the use of the following equation:

$$KASTR1 = (KAST - 1) \times RAST + 1 \quad (4)$$

where KAST represents the initial value of the after-start fuel increasing coefficient KAST calculated at the foregoing step 3, and RAST a predetermined ratio (e.g. 0.5) which is set at such a value as to obtain a desired quantity of fuel supplied to the engine during the after-start fuel increasing period corresponding to the engine temperature, that is, so as to obtain a curve of the product of KTW×KAST approximate to the solid line A in FIG. 1.

Next, at the step 5, it is determined whether or not the value of the after-start fuel increasing coefficient KAST is larger than 1.0. If the present loop is the first loop executed after the engine has left the cranking state, the initial value of the after-start fuel increasing coefficient KAST has just been calculated at the step 3 in the present loop, and accordingly the answer to the question of the step 5 becomes affirmative, thus terminating the execution of the present subroutine.

When the answer to the question of step 1 in FIG. 7 is negative, that is, if the engine was not cranking in the immediately preceding loop, the program proceeds to the step 6 to determine whether or not the value of the after-start fuel increasing coefficient KAST set in the immediately preceding loop is larger than the reference value KASTR1 calculated at the step 4. If the answer to the question of the step 6 is affirmative, a subtracting constant ΔKAST is set to a predetermined value DKAST0, at the step 7, while if the answer to the question of the step 6 is negative, the subtracting constant ΔKAST is set to another predetermined value DKAST1 which is smaller than the predetermined value DKAST0, at the step 8. Then the program proceeds to the step 9, wherein the value of the fuel increasing coefficient KAST is set to a value which is smaller than the value KAST set at the preceding loop by the set subtracting constant ΔKAST. Then at the step 5, it is determined whether or not the thus obtained value of the after-start fuel increasing coefficient KAST is larger than 1.0. If the answer to the step 5 is affirmative, the execution of the present loop of the subroutine is terminated.

Thereafter, the subtraction of step 9 is repeatedly executed upon generation of each pulse of the TDC signal. Therefore, the value of the after-start fuel increasing cefficient KAST is decreased along a bent line, e.g. indicated by the solid line I, II, or III in FIG. 10, which is set depending upon the initial value of the coefficient KAST corresponding to the engine coolant temperature immediately after the cranking of the engine. By virtue of the after-start fuel increasing coefficient KAST which is thus set along a bent line such as the bent lines I, II, III, etc., the product of KTW×KAST is varied along a curve substantially identical with the solid line A in FIG. 1. Therefore, it is possible to accurately set the quantity of fuel required to be supplied to the engine during the after-start fuel increasing period, by employing the after-start fuel increasing coefficient KAST.

When the value of the after-start fuel increasing coefficient KAST is decreased below 1.0 as a result of repeated execution of the subtraction of the step 9, the answer to the question of the step 5 becomes negative. Then, it is judged that the after-start fuel increasing period is over, and then the program proceeds to the step 10 to set the value of the after-start fuel increasing coefficient KAST to 1.0, followed by termination of the execution of the present subroutine.

Figure 11:
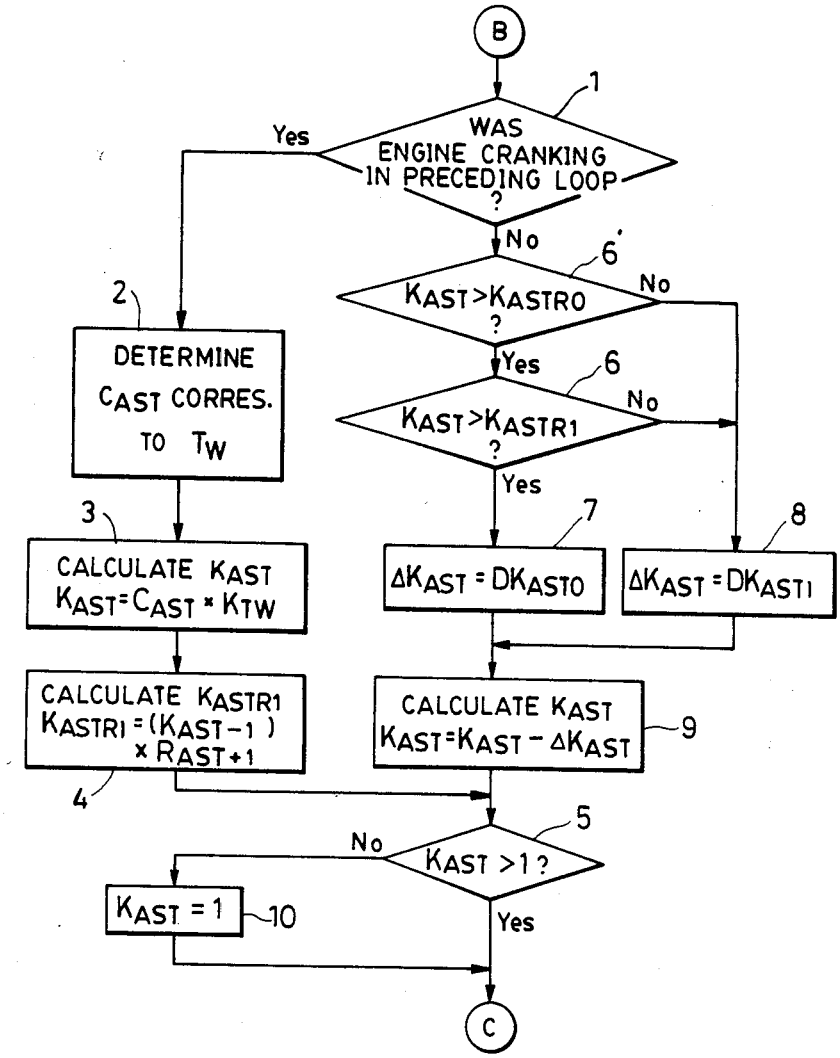
FIG. 11 is a flow chart showing a modified example of the manner of calculating the value of the after-start fuel increasing coefficient KAST shown in FIG. 7.

FIG. 11 is a flow chart showing a modification of the subroutine for calculating the value of the after-start fuel increasing coefficient KAST, shown in FIG. 7. The subroutine of FIG. 11 includes a newly added step 6'. Except for the step 6', the steps in FIG. 11 are identical with the respective ones in FIG. 7.

The step 6' is executed when the answer to the question of step 1 is negative, that is, when the engine was not in a cranking state in the immediately preceding loop. At the step 6', it is determined whether or not the value of the after-start fuel increasing coefficient KAST set in the preceding loop is larger than a predetermined reference value KASTR0. This reference value KASTR0 is provided to increase the after-start fuel increasing period when the initial value of the after-start fuel increasing coefficient KAST is small. The reference value KASTR0 is set to a fixed value larger than 1.0 (e.g. 1.2), as distinct from the aforementioned reference value KASTR1 which is variable depending upon the initial value of the after-start fuel increasing coefficient KAST. If the answer to the question of the step 6' is yes, the program proceeds to the step 6, while the answer to the question of the step 6' is no, the program proceeds to the step 8, wherein the value of subtracting constant ΔKAST is set to the predetermined value DKAST1.

Figure 12:
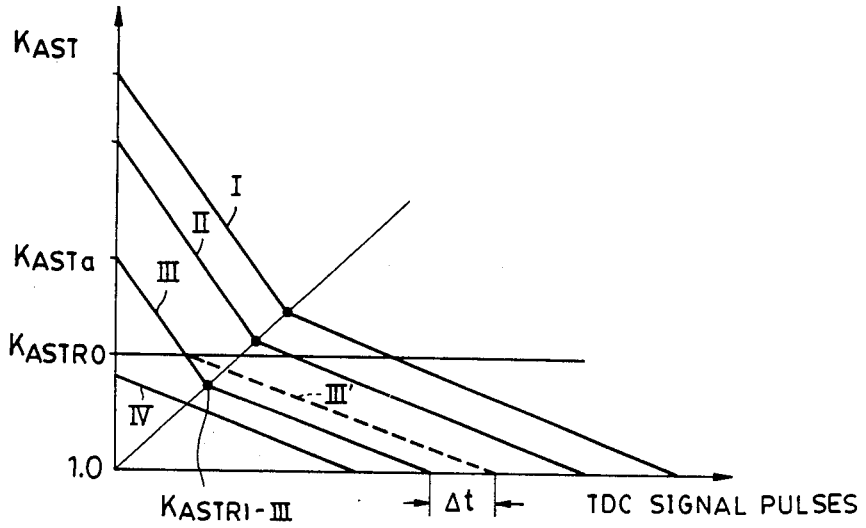
FIG. 12 is a graph showing a manner of decreasing the value of the after-start fuel increasing coefficient, calculated in the manner shown in FIG. 11, upon generation of each pulse of the TDC signal.

By adding the step 6' to the subroutine in FIG. 11, the value of the coefficient KAST can be decreased along a bent line as indicated by the solid lines I, II, III, IV, etc. in FIG. 12, which correspond to respective different values of to the engine coolant temperature immediately ater the cranking of the engine.

When the initial value of the fuel increasing coefficient KAST is large and at the same time the reference value KASTR1 is larger than the fixed reference value KASTR0, the value of the after-start fuel increasing coefficient KAST is decreased along the solid line I or II. When the initial value of the after-start fuel increasing coefficient KAST is small and at the same time the reference value KASTR1–III which is set depending upon the initial value of the coefficient KAST is smaller than the fixed reference value KASTR0 such that the decreasing characteristic of the coefficient KAST is set along the solid line III, the value of the after-start fuel increasing coefficient KAST is decreased along the solid lien III until it becomes equal to the fixed reference value KASTR0, while the value of the coefficient KAST is decreased along a broken line III' in FIG. 12 after it is decreased below the fixed reference value KASTR0. The broken line III' indicates how the value of the coefficient KAST varies as a result of setting at the step 8 executed following the step 6' in FIG. 11. Thus, the after-start fuel increasing period is prolonged by Δt.

Further, when the initial value of the coefficient KAST is smaller than the fixed reference value KASTR0, the value of the coefficient KAST is decreased at the smaller rate from the beginning as indicated by the solid line IV in FIG. 12, so as to gradually lean the air/fuel ratio of the mixture.

As described above, according to the method of the invention, until the value of the after-start fuel increasing coefficient KAST becomes equal to the reference value KASTR0 or KASTR1, the value of the coefficinet is decreased at a larger rate so as to quickly lean the air/fuel ratio of the mixture insofaras it will not cause the engine stall. While, after the value of the after-start fuel increasing coefficient KAST has become smaller than the reference value KASTR1 or the fixed reference value KASTR0, the value of the coefficient KAST is decreased at a smaller rate so as to gradually or slowly lean the air/fuel ratio of the mixture, to thereby ensure stable operation of the engine.

The method according to the invention is applicable not only to an internal combustion engine of the type employed in the foregoing embodiment, but also to an internal combustion engine provided with main combustion chambers and sub combustion chambers.

What is claimed is:

1. A method of controlling the quantity of fuel being supplied to an internal combustion engine after cranking thereof, which is adapted to set an initial value of a fuel increment, which corresponds to the temperature of said engine, upon generation of a predetermined control signal immediately after the cranking of said engine, subsequently decrease the set initial value of said fuel increment at a predetermined rate upon each generation of said predetermined control signal, and supply said engine with a quantity of fuel set by the use of the thus decreased fuel increment, in synchronism with generation of said predetermined control signal, the method comprising the steps of:

(1) comparing the value of said fuel increment with a predetermined reference value upon each generation of said predetermined control signal, said predetermined reference value assuming a value dependent upon the set initial value of said fuel increment;

(2) decreasing the value of said fuel increment at a first rate when it is larger than said predetermined reference value; and (3) decreasing the value of said fuel increment at a second rate which is small than said first rate when the value of said fuel increment is smaller than said predetermined reference value.

2. A method as claimed in claim 1, wherein said predetermined reference value is a product obtained by multiplying the set initial value of said fuel increment by predetermined coefficient.

3. A method of controlling the quantity of fuel being supplied to an internal combustion engine after cranking thereof, which is adapted to set an initial value of a fuel increment, which corresponds to the temperature of said engine, upon generation of a predetermined control signal immediately after the cranking of said engine, subsequently decrease the set initial value of said fuel increment at a predetermined rate upon each generation of said predetermined control signal, and supply said engine with a quantity of fuel set by the use of the thus decreased fuel increment, in synchronism with generation of said predetermined control signal, the method comprising the steps of:

(1) comparing the value of said fuel increment with a predetermined reference value upon each generation of said predetermined control signal;

(2) decreasing the value of said fuel increment at a first rate when it is larger than said predetermined reference value;

(3) decreasing the value of said fuel increment at a second rate which is smaller than said first rate when the value of said fuel increment is smaller than said predetermined reference value; and (4) comparing the value of said fuel increment with a fixed value upon each generation of said predetermined control signal, and decreasing the value of said fuel increment at said second rate when the value of said fuel increment is smaller than said fixed value, even if the value of said fuel increment is larger than said predetermined reference value.

4. A method as claimed in claim 3, wherein said predetermined reference value assumes a value dependent upon the set initial value of said fuel increment.

5. A method as claimed in claim 3, wherein said predetermined reference value is a product obtained by multiplying the set initial value of said fuel increment by a predetermined coefficient.

* * * * *